US011024991B2

(12) United States Patent
Li et al.

(10) Patent No.: US 11,024,991 B2
(45) Date of Patent: Jun. 1, 2021

(54) RECEPTACLE TERMINAL

(71) Applicant: Tyco Electronics (Shanghai) Co. Ltd., Shanghai (CN)

(72) Inventors: Xinxin Li, Shanghai (CN); Tongbao Ding, Shanghai (CN); Xing Tong, Shanghai (CN); Weiguo Li, Shanghai (CN); Liming Wang, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/793,554

(22) Filed: Feb. 18, 2020

(65) Prior Publication Data

US 2020/0266561 A1 Aug. 20, 2020

(30) Foreign Application Priority Data

Feb. 18, 2019 (CN) ..... 201920210979.3

(51) Int. Cl.
*H01R 11/11* (2006.01)
*H01R 13/11* (2006.01)

(52) U.S. Cl.
CPC ..... *H01R 11/11* (2013.01); *H01R 13/11* (2013.01)

(58) Field of Classification Search
CPC ..... H01R 11/11; H01R 11/10; H01R 13/11; H01R 13/02
USPC ..... 439/881, 850–854, 352
See application file for complete search history.

(56) References Cited

U.S. PATENT DOCUMENTS 3,183,471 A * 5/1965 Burkert ..... H01R 13/115 439/442
4,220,388 A * 9/1980 Dechelette ..... H01R 13/115 439/268
4,534,613 A * 8/1985 Esser ..... H01R 13/20 439/834
5,733,154 A * 3/1998 Libregts ..... H01R 4/182 439/850
6,039,615 A * 3/2000 Suzuki ..... H01R 13/113 439/849
9,692,163 B1 * 6/2017 Didonato ..... H01R 4/70
10,079,440 B1 9/2018 Didonato et al.
10,256,561 B2 * 4/2019 Humphrey ..... H01R 13/14
(Continued)

FOREIGN PATENT DOCUMENTS

CN 103746206 A 4/2014
CN 105552614 A 5/2016
(Continued)

OTHER PUBLICATIONS

Abstract of DE 102006001102, dated Jul. 12, 2007, 1 page.

*Primary Examiner* — Harshad C Patel
(74) *Attorney, Agent, or Firm* — Barley Snyder

(57) ABSTRACT

A receptacle terminal includes a base portion having a plate shape extending in a transverse direction and a longitudinal direction and a plurality of pairs of elastic arms arranged in sequence and spaced apart from each other in the longitudinal direction. Each of the elastic arms has a contact portion contacting a plug terminal inserted into the receptacle terminal. A distance from the contact portions of a middle pair of elastic arms to the base portion is less than a distance from the contact portions of another two pairs of elastic arms to the base portion.

17 Claims, 3 Drawing Sheets

(56) References Cited

U.S. PATENT DOCUMENTS

| | | | | |
|---|---|---|---|---|
| 2005/0233638 | A1* | 10/2005 | Taylor | H01R 4/183<br>439/585 |
| 2013/0295799 | A1* | 11/2013 | Ishii | H01R 11/01<br>439/884 |
| 2018/0013212 | A1 | 1/2018 | Didonato et al. | |

FOREIGN PATENT DOCUMENTS

| | | | |
|---|---|---|---|
| CN | 207588027 | U | 7/2018 |
| CN | 208111733 | U | 11/2018 |
| DE | 102006001102 | A1 | 7/2007 |
| KR | 200165215 | U | 2/2000 |
| KR | 20110001738 | U | 2/2011 |
| KR | 200471889 | Y1 | 3/2014 |
| WO | 2018185596 | A1 | 10/2018 |

* cited by examiner

RECEPTACLE TERMINAL

CROSS-REFERENCE TO RELATED APPLICATION

This application claims the benefit of the filing date under 35 U.S.C. § 119(a)-(d) of Chinese Patent Application No. 201920210979.3, filed on Feb. 18, 2019.

FIELD OF THE INVENTION

The present invention relates to an electrical terminal and, more particularly, to a receptacle terminal.

BACKGROUND

A receptacle terminal generally comprises a plate-shaped base portion and a pair of elastic arms connected to either side of the plate-shaped base portion. The elastic arm is a single integral curved-type component, which means the elastic arm has a larger overall rigidity. Therefore, when a plug terminal is inserted into the receptacle terminal, a contact pressure exerted by the elastic arm onto the plug terminal is too large, resulting in excessive insertion force for inserting the plug terminal, which makes the insertion operation of the plug terminal very difficult.

SUMMARY

A receptacle terminal includes a base portion having a plate shape extending in a transverse direction and a longitudinal direction and a plurality of pairs of elastic arms arranged in sequence and spaced apart from each other in the longitudinal direction. Each of the elastic arms has a contact portion contacting a plug terminal inserted into the receptacle terminal. A distance from the contact portions of a middle pair of elastic arms to the base portion is less than a distance from the contact portions of another two pairs of elastic arms to the base portion.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
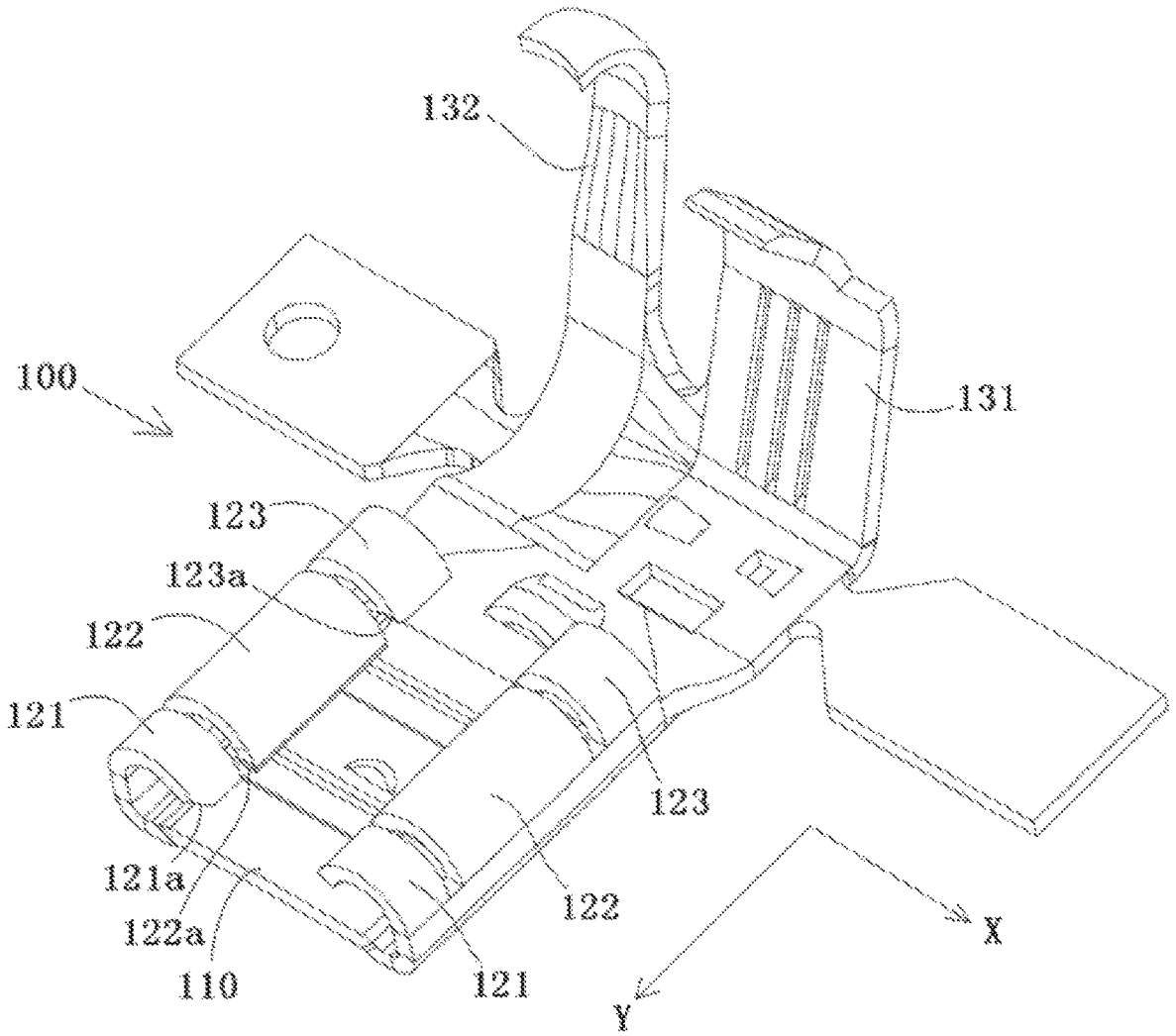
FIG. 1 is a perspective view of a receptacle terminal according to an embodiment.

Technical solutions of the present disclosure will be described in detail through the embodiments in conjunction with the accompanying drawings. In the description, the same or similar reference numerals indicate the same or similar components. The following description of the embodiments of the present disclosure with reference to the drawings is intended to explain a general concept of the present disclosure, and should not be construed as a limitation on the present disclosure.

In the following detailed description, for ease of explanation, many specific details are set forth to provide a comprehensive understanding of the embodiments of the present disclosure. One or more embodiments, however, may be practiced without these specific details. In other cases, well-known structures and devices are schematically illustrated to simplify the drawings.

Figure 2:
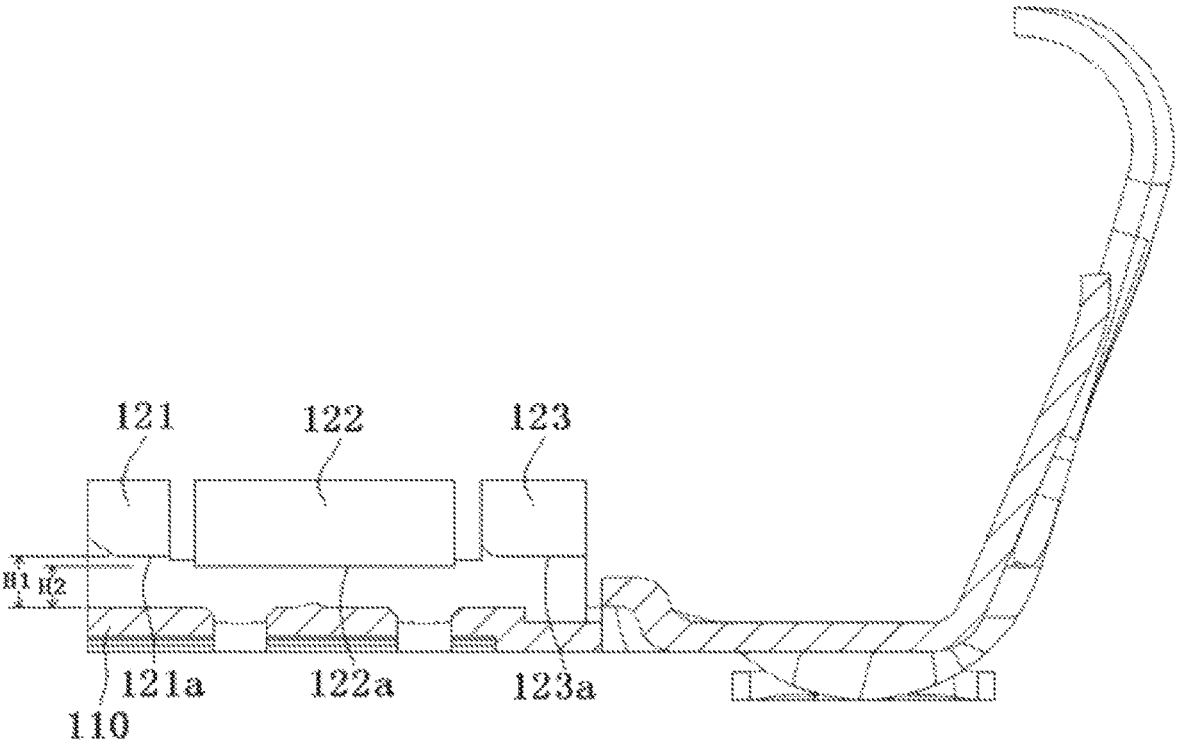
FIG. 2 is a sectional side view of the receptacle terminal.
Figure 3:
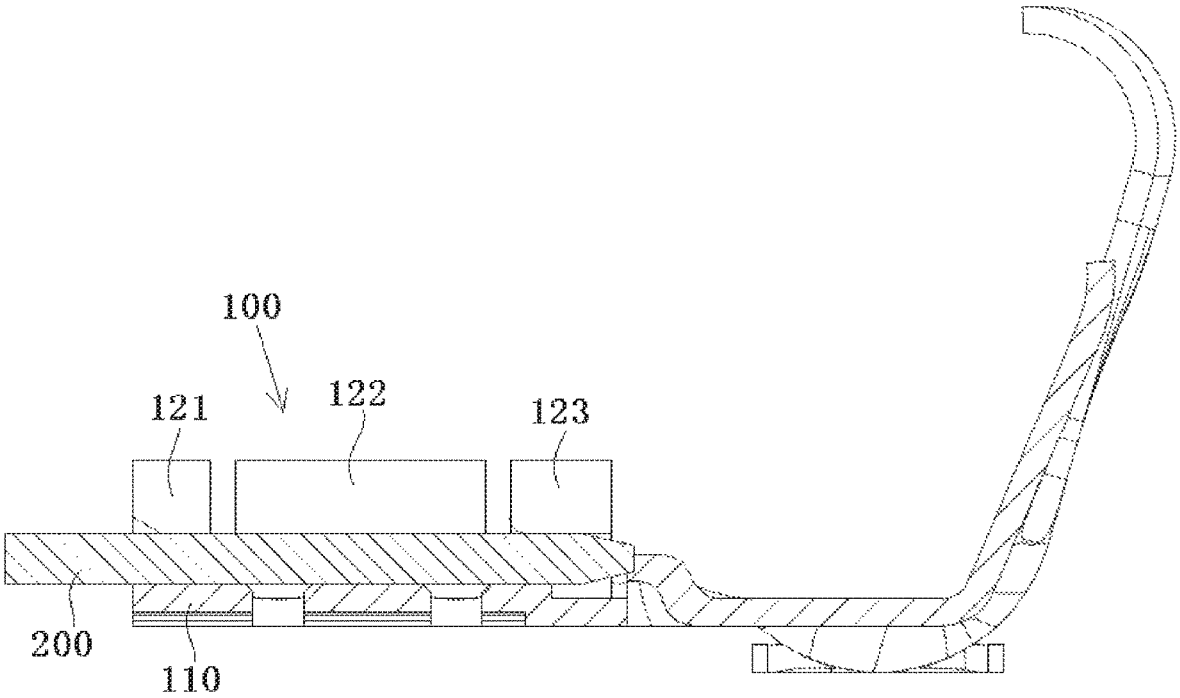
FIG. 3 is a sectional side view of the receptacle terminal with a plug terminal inserted therein.

A receptacle terminal 100 according to an embodiment, as shown in FIGS. 1-3, comprises a base portion 110 and a plurality of pairs of elastic arms 121, 122 and 123. In the shown embodiment, the receptacle terminal 100 includes three pairs of elastic arms 121, 122, and 123. The base portion 110 has a plate shape with a transverse direction X and a longitudinal direction Y. The three pairs of elastic arms 121, 122 and 123 are arranged in sequence and apart from each other in the longitudinal direction Y of the base portion 110.

As shown in FIGS. 1-3, the plurality of elastic arms 121, 122, 123 each have contact portions 121*a*, 122*a*, 123*a* suitable for contacting with the plug terminal 200 inserted into the receptacle terminal 100. A distance H2 of the contact portions 122*a* of a middle pair of elastic arms 122 among the three pairs of elastic arms 121, 122 and 123 to the base portion 110 is less than a distance H1 of the contact portions 121*a*, 123*a* of the other two pairs of elastic arms 121, 123 to the base portion 110.

When the plug terminal 200 is inserted into the receptacle terminal 100, an elastic deformation amount of the middle pair of elastic arms 122 is greater than elastic deformation amounts of the other two pairs of elastic arms 121, 123. Therefore, a contact pressure exerted by the two outside pairs of elastic arms 121, 123 on the plug terminal 200 is smaller, reducing an overall contact pressure exerted by the receptacle terminal 100 on the plug terminal 200, making it easy to insert the plug terminal 200 into the receptacle terminal 100.

The three pairs of elastic arms 121, 122, 123, as shown in FIGS. 1-3, include a pair of first elastic arms 121, a pair of second elastic arms 122, and a pair of third elastic arms 123. The pair of second elastic arms 122 (i.e., the middle pair of elastic arms 122) are located between the pair of first elastic arms 121 and the pair of third elastic arms 123 in the longitudinal direction Y. The distance H1 from the contact portion 121*a* of the first elastic arm 121 to the base portion 110 is equal to the distance H1 from the contact portion 123*a* of the third elastic arm 123 to the base portion 110.

In an embodiment, as shown in FIG. 2, the distance H2 of the contact portion 122*a* of the second elastic arm 122 to the base portion 110 is equal to 0.7-0.9 times the distance H1 from the contact portions 121*a*, 123*a* of the first and third elastic arms 121, 123 to the base portion 110. In an embodiment, the distance H1 from the contact portions 121*a*, 123*a* of the first and third elastic arms 121, 123 to the base portion 110 is slightly less than a thickness of a tongue of the plug terminal 200 inserted into the receptacle terminal 100. As such, when the plug terminal 200 is inserted into the receptacle terminal 100, the contact pressure exerted by the first elastic arms 121 and the third elastic arm 123 on the plug terminal 200 is nearly zero.

In an embodiment, as shown in FIGS. 1-3, a width of the second elastic arm 122 in the longitudinal direction Y of the base portion 110 is greater than the widths of the first elastic arm 121 and the third elastic arm 123 in the longitudinal direction Y of the base portion 110.

As shown in FIGS. 1-3, the pair of first elastic arms 121 are symmetrically disposed on either side of the base portion 110 in the transverse direction X, and are respectively connected to two sides of the base portion 110 in the transverse direction X. The pair of second elastic arms 122 are symmetrically disposed on either side of the base portion 110 in the transverse direction X, and are respectively connected to two sides of the base portion 110 in the transverse direction X. The pair of third elastic arms 123 are symmetrically disposed on either side of the base portion 110 in the transverse direction X, and are respectively connected to two sides of the base portion 110 in the transverse direction X. The pair of first elastic arms 121 and the pair of second elastic arms 122 are spaced apart in the longitudinal direction Y of the base portion 110. The pair of second elastic arms 122 and the pair of third elastic arms 123 are spaced apart in the longitudinal direction Y of the base portion 110.

In the embodiment shown in FIGS. 1-3, the first elastic arms 121, the second elastic arms 122, and the third elastic arm 123 are respectively bent inwardly into an arc shape from either side of the base portion 110.

As shown in FIG. 3, when the plug terminal 200 is inserted into the receptacle terminal 100, the plug terminal 200 is clamped between the elastic arms 121, 122, 123 and the base portion 110. When the plug terminal 200 is inserted into the receptacle terminal 100, the pressing force exerted by the second elastic arm 122 on the plug terminal 200 is greater than the sum of pressing forces exerted by the first elastic arms 121 and the third elastic arms 123 on the plug terminal 200. The contact portions 121*a* of the first elastic arms 121 and the contact portions 123*a* of the third elastic arms 123 respectively abut against a rear end and a front end of the plug terminal 200 to prevent the rear end and the front end of the plug terminal 200 from moving upwardly. In this way, the first elastic arms 121 and the third elastic arms 123 can function as a stop to prevent the plug terminal 200 from shaking up and down in the receptacle terminal 100.

The receptacle terminal 100, as shown in FIG. 1, further comprises press-connecting portions 131 and 132, which are connected to a rear end of the base portion 110 in the longitudinal direction Y and which are suitable for connecting with a conducting wire in a pressing manner. The press-connecting portions 131, 132 include a first press-connecting portion 131 suitable for pressing onto and connecting with a conductor of a conducting wire, and a second press-connecting portion 132 suitable for pressing onto an outer cladding of the conducting wire.

Those skilled in the art can understand that the embodiments described above are all exemplary, and those skilled in the art can improve them. The structures described in the various embodiments can be combined freely without conflicting in structure or principle. Although the present disclosure is described with reference to the accompanying drawings, the embodiments disclosed in the drawings are intended to exemplarily illustrate the present disclosure, and should not be understood as a limitation on the present disclosure. Although some embodiments of the general concept of the present disclosure have been shown and described, those skilled in the art will understand that modifications can be made to these embodiments without departing from the principles and spirit of the general concept of the present disclosure. The scope of present disclosure is defined by the claims and their equivalents.

What is claimed is:

1. A receptacle terminal, comprising:

a base portion having a plate shape extending in a transverse direction and a longitudinal direction; and a plurality of pairs of elastic arms arranged in sequence and spaced apart from each other in the longitudinal direction, each of the elastic arms having a contact portion contacting a plug terminal inserted into the receptacle terminal, a distance from the contact portions of a middle pair of elastic arms to the base portion is less than a distance from the contact portions of another two pairs of elastic arms to the base portion.

2. The receptacle terminal of claim 1, wherein the plurality of pairs of elastic arms include a pair of first elastic arms, a pair of second elastic arms, and a pair of third elastic arms, the pair of second elastic arms are located between the pair of first elastic arms and the pair of third elastic arms in the longitudinal direction.

3. The receptacle terminal of claim 2, wherein the distance from the contact portions of the first elastic arms and the third elastic arms to the base portion is less than a thickness of a tongue of the plug terminal inserted into the receptacle terminal.

4. The receptacle terminal of claim 2, wherein the distance from the contact portions of the first elastic arms to the base portion is equal to the distance from the contact portions of the third elastic arms to the base portion.

5. The receptacle terminal of claim 4, wherein the distance from the contact portions of the second elastic arms to the base portion is equal to 0.7-0.9 times of the distance from the contact portions of the first elastic arms and the third elastic arms to the base portion.

6. The receptacle terminal of claim 2, wherein a width of the second elastic arms in the longitudinal direction is greater a width of the first elastic arms and the third elastic arms in the longitudinal direction.

7. The receptacle terminal of claim 2, wherein the pair of first elastic arms are symmetrically disposed on and connected to opposite sides of the base portion in the transverse direction.

8. The receptacle terminal of claim 7, wherein the pair of second elastic arms are symmetrically disposed on and connected to opposite sides of the base portion in the transverse direction.

9. The receptacle terminal of claim 8, wherein the pair of third elastic arms are symmetrically disposed on and connected to opposite sides of the base portion in the transverse direction.

10. The receptacle terminal of claim 2, wherein the pair of first elastic arms and the pair of second elastic arms are spaced apart in the longitudinal direction, and the pair of second elastic arms and the pair of third elastic arms are spaced apart in the longitudinal direction.

11. The receptacle terminal of claim 2, wherein the first elastic arms, the second elastic arms, and the third elastic arms are each curved inwardly into an arc shape from opposite sides of the base portion.

12. The receptacle terminal of claim 2, wherein the plug terminal is clamped between the first elastic arms, the second elastic arms, and the third elastic arms and the base portion when the plug terminal is inserted into the receptacle terminal.

13. The receptacle terminal of claim 12, wherein a pressing force exerted by the second elastic arms on the plug terminal is greater than a sum of pressing forces exerted by the first elastic arms and the third elastic arms on the plug terminal.

14. The receptacle terminal of claim 12, wherein the contact portions of the first elastic arms and the contact portions of the third elastic arms abut against a rear end and a front end of the plug terminal to prevent the rear end and the front end of the plug terminal from moving upwardly.

15. The receptacle terminal of claim 1, further comprising a press-connecting portion connected to a rear end of the base portion in the longitudinal direction, the press-connecting portion pressed onto and connected with a conducting wire.

16. The receptacle terminal of claim 15, wherein the press-connecting portion includes a first press-connecting portion pressed onto and connected with a conductor of the conducting wire and a second press-connecting portion pressed onto an outer cladding of the conducting wire.

17. A receptacle terminal, comprising:

a base portion having a plate shape extending in a transverse direction and a longitudinal direction; and a plurality of pairs of elastic arms arranged in sequence and spaced apart from each other in the longitudinal direction, each of the elastic arms having a contact portion contacting a plug terminal inserted into the receptacle terminal, a distance from the contact portions of a first pair of elastic arms to the base portion is less than a distance from the contact portions of a second pair of elastic arms to the base portion.

* * * * *